US005938306A

United States Patent [19]

Lambright et al.

[11] Patent Number: 5,938,306

[45] Date of Patent: Aug. 17, 1999

[54] CABINET AND DOOR ASSEMBLY

[75] Inventors: Michael D. Lambright, Archbold; Richard A. Nelson, Napoleon; Steven R. Munday, Stryker, all of Ohio

[73] Assignee: Sauder Woodworking Co., Archbold, Ohio

[21] Appl. No.: 09/034,074

[22] Filed: Mar. 3, 1998

[51] Int. Cl.[6] ..... A47B 88/00

[52] U.S. Cl. ..... 312/325; 312/324

[58] Field of Search ..... 312/139, 324, 312/325, 326, 329; 160/210, 183

[56] References Cited

U.S. PATENT DOCUMENTS

| | | |
|---|---|---|
| 184,375 | 11/1876 | Hansen . |
| 654,922 | 7/1990 | Schipkowsky . |
| 1,507,760 | 9/1924 | Sutherland . |
| 1,543,980 | 6/1925 | Blood . |
| 1,559,705 | 11/1925 | Jackson . |
| 1,798,800 | 3/1931 | Macknight . |
| 1,948,703 | 2/1934 | Fanarjian . |
| 3,078,133 | 2/1963 | Schauer . |
| 3,089,745 | 5/1963 | Postula et al. . |
| 3,241,900 | 3/1966 | Hamilton et al. . |
| 3,510,187 | 5/1970 | Schreyer . |
| 3,862,785 | 1/1975 | Scheerhorn et al. . |
| 4,272,136 | 6/1981 | Sengua . |
| 4,348,069 | 9/1982 | Lindsay ..... 312/324 |
| 4,502,742 | 3/1985 | Neff . |
| 4,755,009 | 7/1988 | Price et al. . |
| 5,121,974 | 6/1992 | Monson . |
| 5,145,245 | 9/1992 | Fierthaler . |
| 5,147,122 | 9/1992 | Short . |
| 5,287,815 | 2/1994 | Gross . |
| 5,558,418 | 9/1996 | Lambright et al. . |

FOREIGN PATENT DOCUMENTS

| | | |
|---|---|---|
| 332963 | 11/1903 | France . |
| 75777 | 11/1893 | Germany . |
| 108670 | 2/1925 | Sweden . |

*Primary Examiner*—Janet M. Wilkens
*Assistant Examiner*—Karlena D. Schwing
*Attorney, Agent, or Firm*—Emch, Schaffer, Schaub & Porcello Co., L.P.A.

[57] ABSTRACT

A cabinet and door assembly including a cabinet having a horizontal member such as a top including a lower surface and at least one side wall. The assembly further includes at least one first door member pivotly mounted on at least one second door member. The second door member is pivotly mounted on the side wall of the cabinet. The first and second door members are moveable between closed and open positions. The assembly further includes a hinge assembly operatively connected to the lower surface and the first door member for guiding the first and second door members during movement between the closed and open positions.

11 Claims, 6 Drawing Sheets

CABINET AND DOOR ASSEMBLY

BACKGROUND OF THE INVENTION

The present invention relates generally to a door assembly for a cabinet. More specifically, the invention is directed to a cabinet having first and second door members operatively connected to a hinge assembly that guides the door members during movement between closed and open positions.

Cabinets having doors are known in the art. An example of a known cabinet includes two doors that are mounted by hinges on spaced side walls of the cabinet. The doors are moveable between closed positions and open positions. It has been found that the doors of these prior art cabinets can be bulky and unwieldy especially when they are large because they extend continuously from the side walls to the edges of the doors.

In response to the above-identified problem with continuous cabinet doors, doors having two sections were developed. These types doors are commonly referred to as "folding doors". In this type of door, the door sections are joined by hinges to provide pivotal movement with respect to one another. One of the door sections is in turn mounted on a side wall of the cabinet by hinges. This mounting arrangement allows the two door sections to fold upon themselves as the door is being opened. However, there has been a problem with this type of door because the individual sections are not guided or controlled during and after opening. Instead, these types of doors are free to move about the cabinet. This can result in the door sections contacting persons, furniture, or other items in the vicinity of the cabinet to which the doors are attached. It has also been found that the free movement of the door section can result in undesired noise during opening and closing of the doors as the doors strike the cabinet.

In view of the foregoing, it is apparent that there is a need for a door assembly for a cabinet that provides for the guided and controlled movement of individual door section during opening and closing. The resent invention satisfies this need.

SUMMARY OF THE INVENTION

The present invention is directed to a door assembly for a cabinet in which the cabinet has a top having a lower surface including a middle portion and a front portion. The door assembly includes at least one first door member, at least one second door member and at least one side wall. The first door member is pivotly mounted on the second door member. The second door member is pivotly mounted on the side wall. The first and second door members are moveable between closed and open positions.

The door assembly further includes a hinge assembly. The hinge assembly is operatively connected to the lower surface of the top and the first door member for guiding the first and second door members during movement between the closed and open positions.

It is the primary object of the present invention to provide a door assembly for a cabinet that allows for the guided movement of the door assembly during opening and closing.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 1:
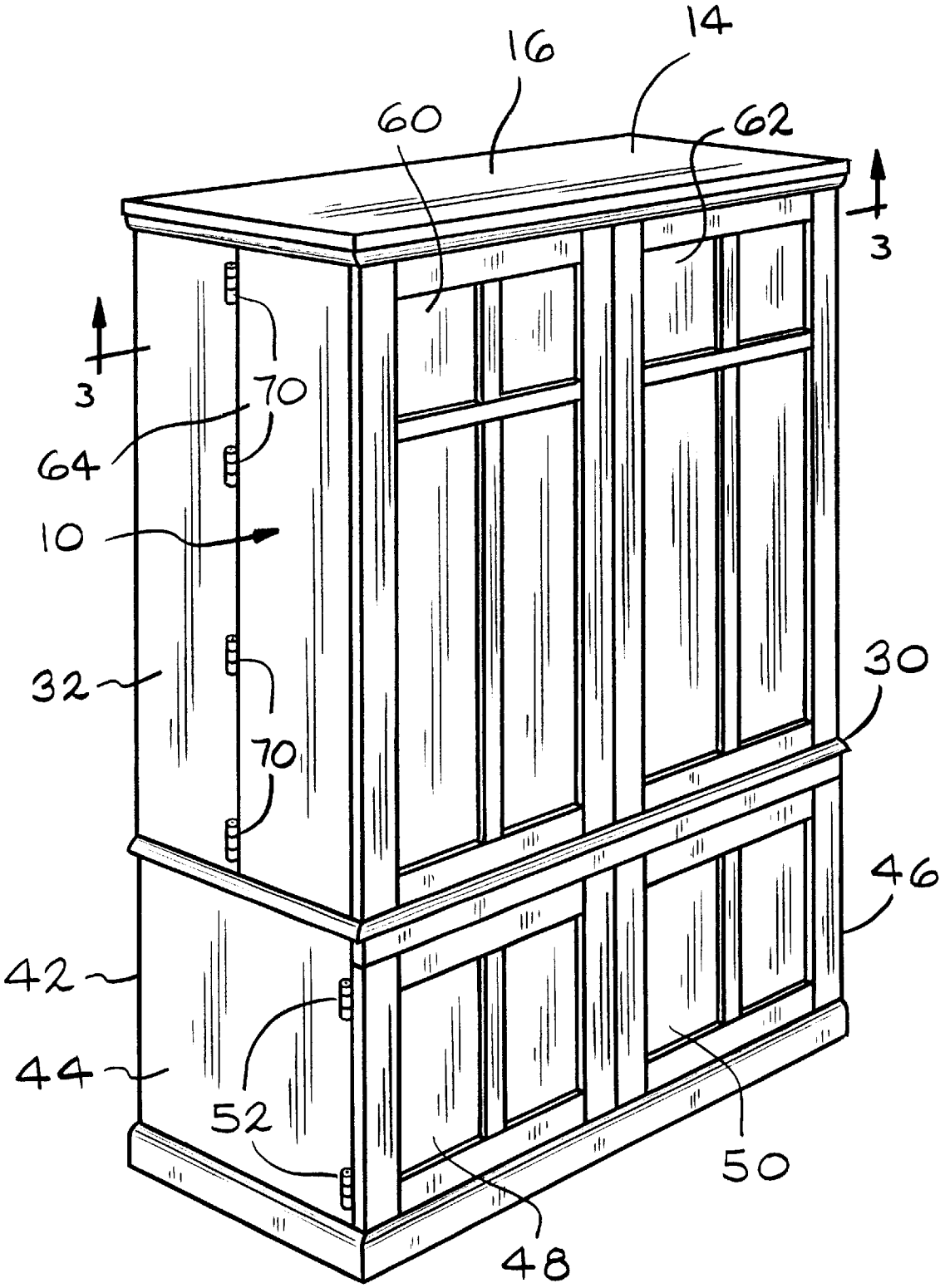
FIG. 1 is a perspective view of a cabinet incorporating a door assembly according to the present invention in which the doors are in a closed position.

The preferred embodiments and best mode of the present invention will now be described in detail with reference being made to the drawings. The door assembly according to the present invention is indicated generally in the drawings by the reference number "10".

Figure 2:
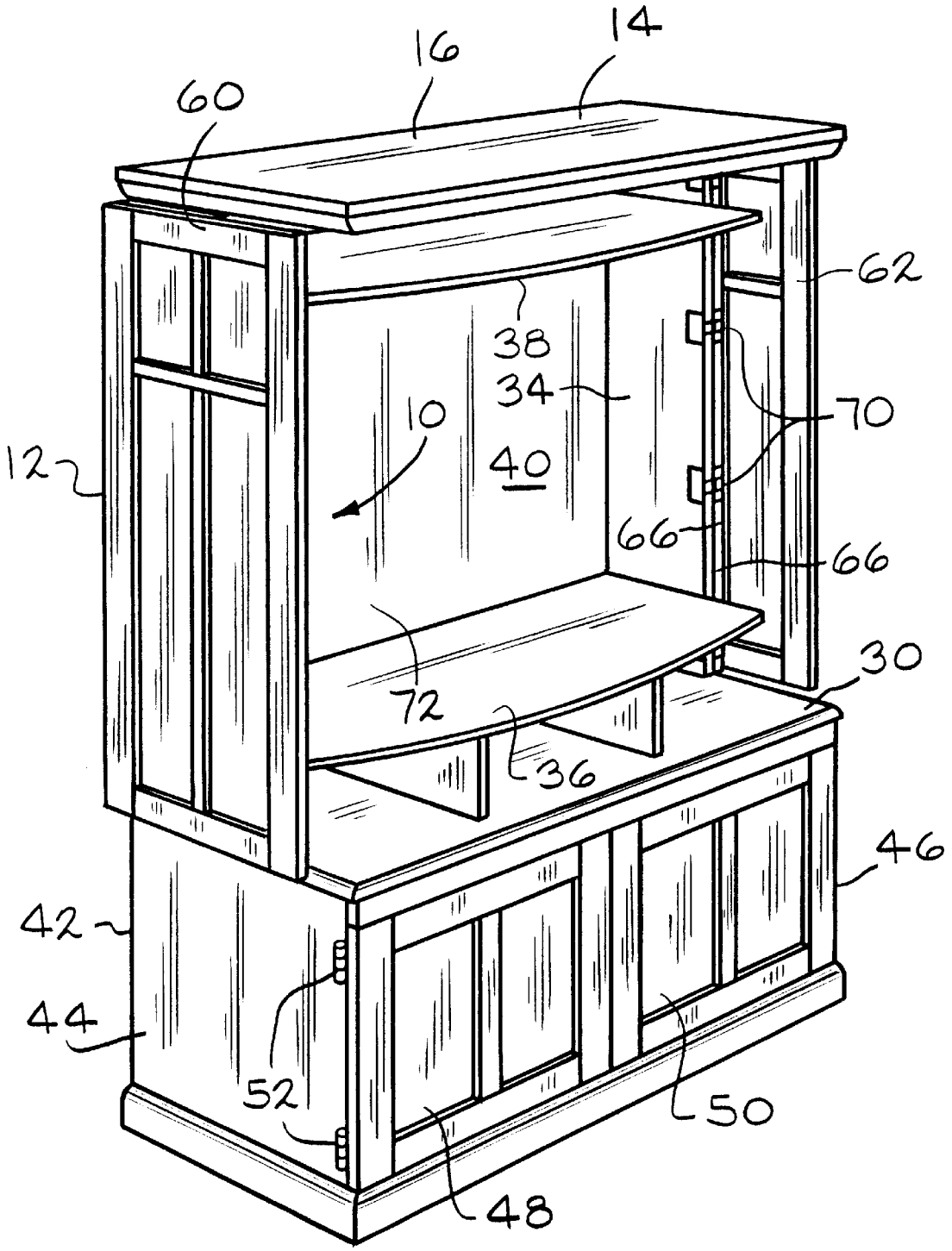
FIG. 2 is a view similar to the view of FIG. 1 in which the doors are in an open position.
Figure 3:
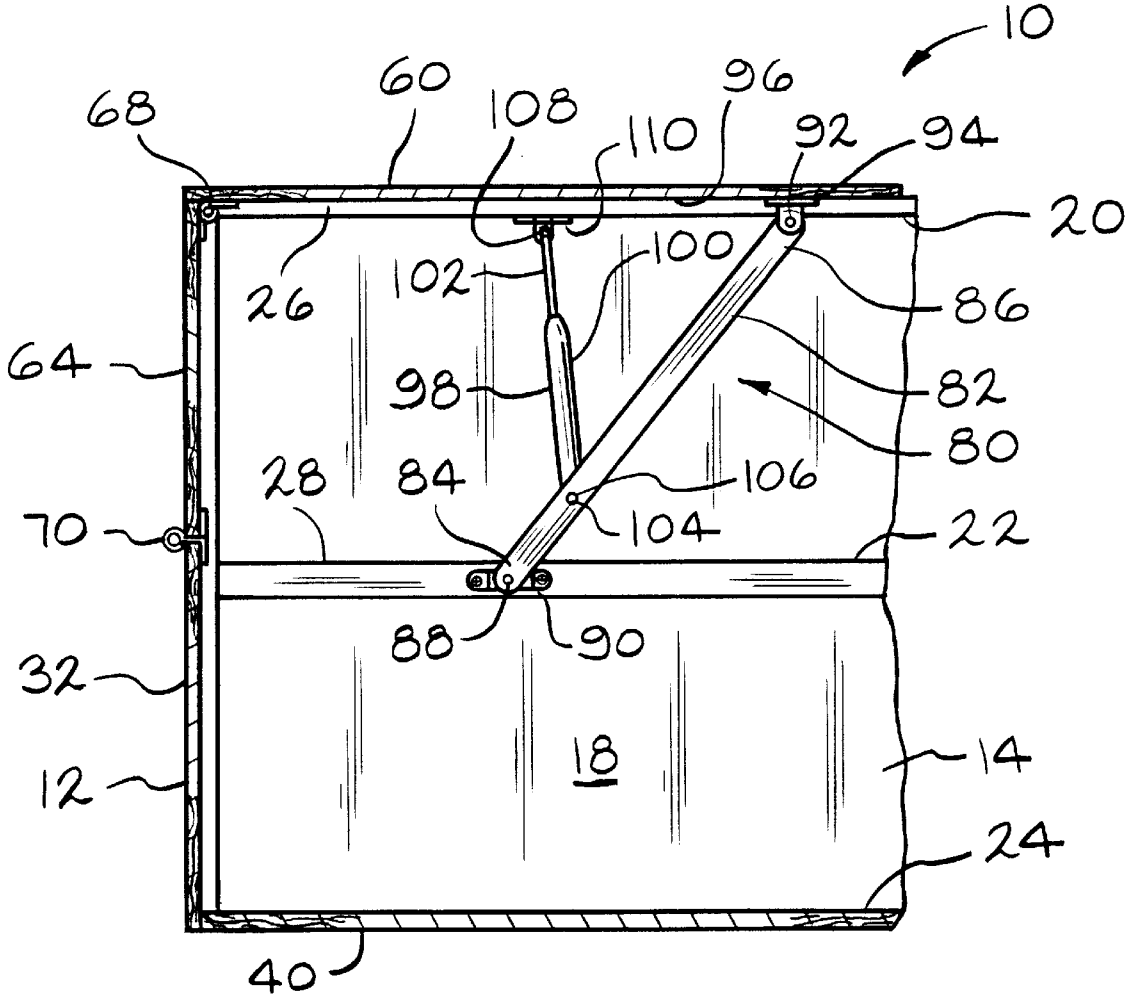
FIG. 3 is a cross-sectional view taken through line 3—3 of FIG. 1.

Referring to FIGS. 1–3, the door assembly 10 includes a cabinet 12 having a top 14 including an upper surface 16 and a lower surface 18. As shown in FIG. 3, the lower surface 18 includes a front portion 20, a middle portion 22 and a back portion 24. The front portion 20 includes a front rail 26 and the middle portion 22 includes a middle rail 28. Referring again to FIGS. 1–3, the cabinet 12 includes a base 30. First and second side walls 32 and 34 extend between the base 30 and the top 14 in spaced relationship. As shown in FIG. 2, a support shelf 36 extends substantially between the first and second side walls 32 and 34. The support shelf 36 can support, for example, a television. The cabinet 12 further includes a top shelf 38 that extends substantially between the first and second side walls 32 and 34. A back 40 is positioned adjacent the top 14, the base 30, the first side wall 32 and the second side wall 34.

Referring to FIGS. 1 and 2, a preferred embodiment of the cabinet 12 includes a lower compartment 42. The lower compartment 42 includes first and second lower compartment walls 44 and 46. First and second lower compartment doors 48 and 50 are pivotly mounted by hinges 52 on the first and second lower compartment walls 44 and 46, respectively.

Referring to FIGS. 1–3, the door assembly 10 includes two first door members 60 and 62 that extend between the top 14 and the base 30. The assembly 10 further includes two second door members 64 and 66 that extend between the top 14 and the base 30. As shown in FIG. 3, the first door members 60 and 62, as represented by first door member 60, are pivotly mounted on the second door members 64 and 66, as represented by second door 64, by hinges 68. The second door members 64 and 66, as represented by second door member 64, are pivotly mounted on the first and second side walls 32 and 34, as represented by first side wall 32, by hinges 70. As shown in FIGS. 1 and 2, the first and second door members 60, 62, 64 and 66, respectively, are moveable between a closed position as shown in FIG. 1 and an open position as shown in FIG. 2. When in a closed position, the top 14, the base 30, the first door members 60 and 62, the second door members 64 and 66, the first and second side walls 32 and 34 and the back 40 define a compartment 72.

Referring to FIGS. 3–6, the assembly 10 includes a hinge assembly 80 for each set of first and second door members 60, 62, 64 and 66, respectively. As represented by first and second door members 60 and 64, the hinge assembly 80 is operatively connected to the lower surface 18 of the top 14 and the first door member 60 for guiding and controlling the first and second door members 60 and 64 during movement between the closed and open positions.

As shown in FIG. 3, each hinge assembly 80 has an arm 82 that includes a first end 84 and a second end 86. The first end 84 is pivotly mounted on the middle rail 28 of the middle portion 22 by a pivot pin 88 that is operatively connected to a bracket 90 that is fixedly attached to the middle rail. The second end 86 of the arm 82 is pivotly mounted on the first door member 60 by a pivot pin 92 that is operatively connected to a bracket 94 that is fixedly attached to the interior surface 96 of the first door member 60. The hinge assembly 80 further includes a stay 98 that includes a housing 100 and a reciprocating piston 102 that is movably positioned in the housing 100 by a spring (not shown). The housing 100 is pivotly mounted by a rivet 104 that is received by an opening 106 defined at a predetermined location on the arm 82 between the first and second ends 84 and 86. The piston 102 is pivotly mounted on the front rail 26 of the front portion 20 of the top 14 by a rivet 108 that is received by a bracket 110 that is fixedly attached to the front rail. It should also be understood that the bracket 110 can be attached directly to the lower surface 18 of the top 14 depending on the application.

Figure 4:
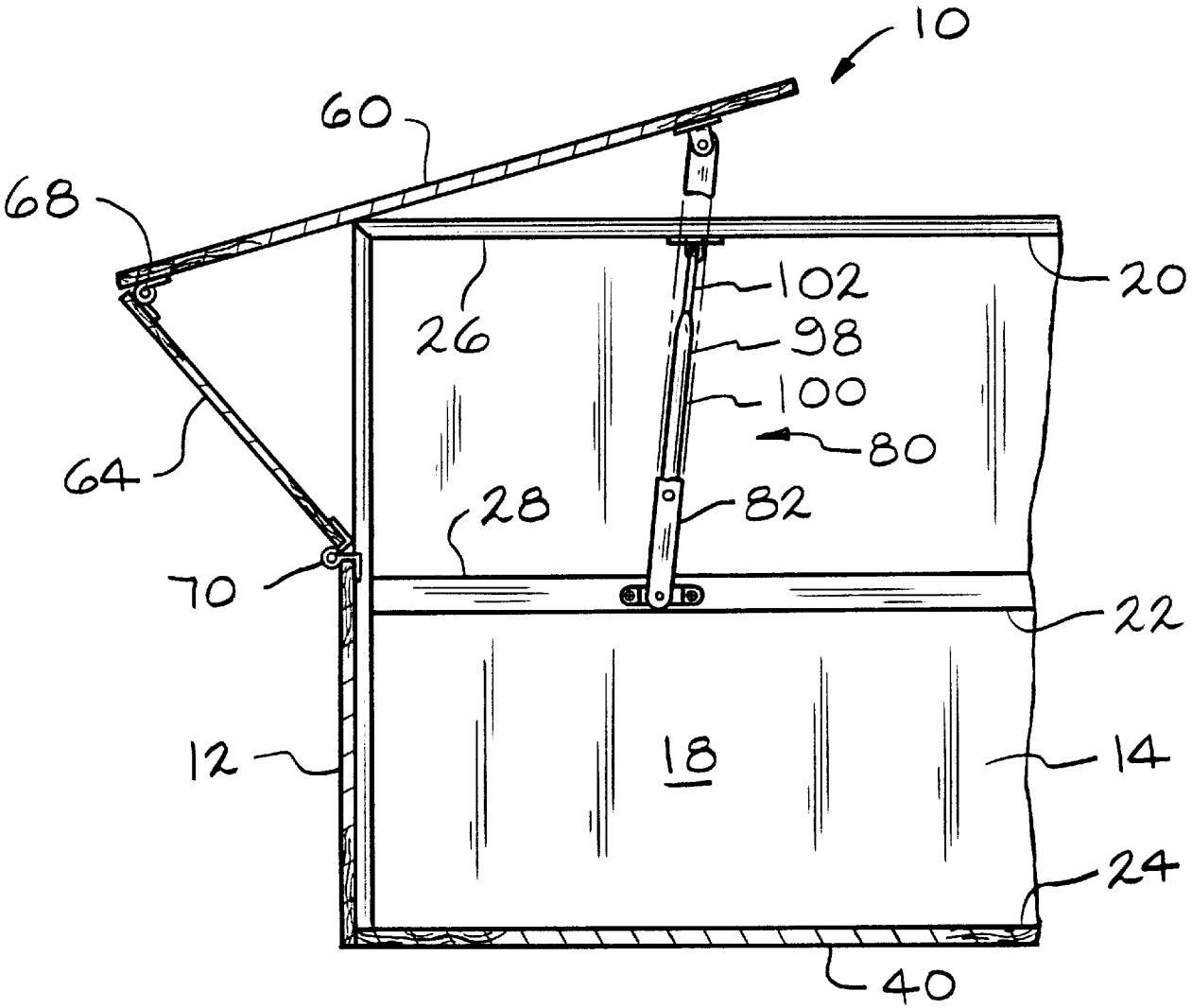
FIG. 4 is a view similar to the view of FIG. 3 in which the first and second door members are in a partially open position.
Figure 5:
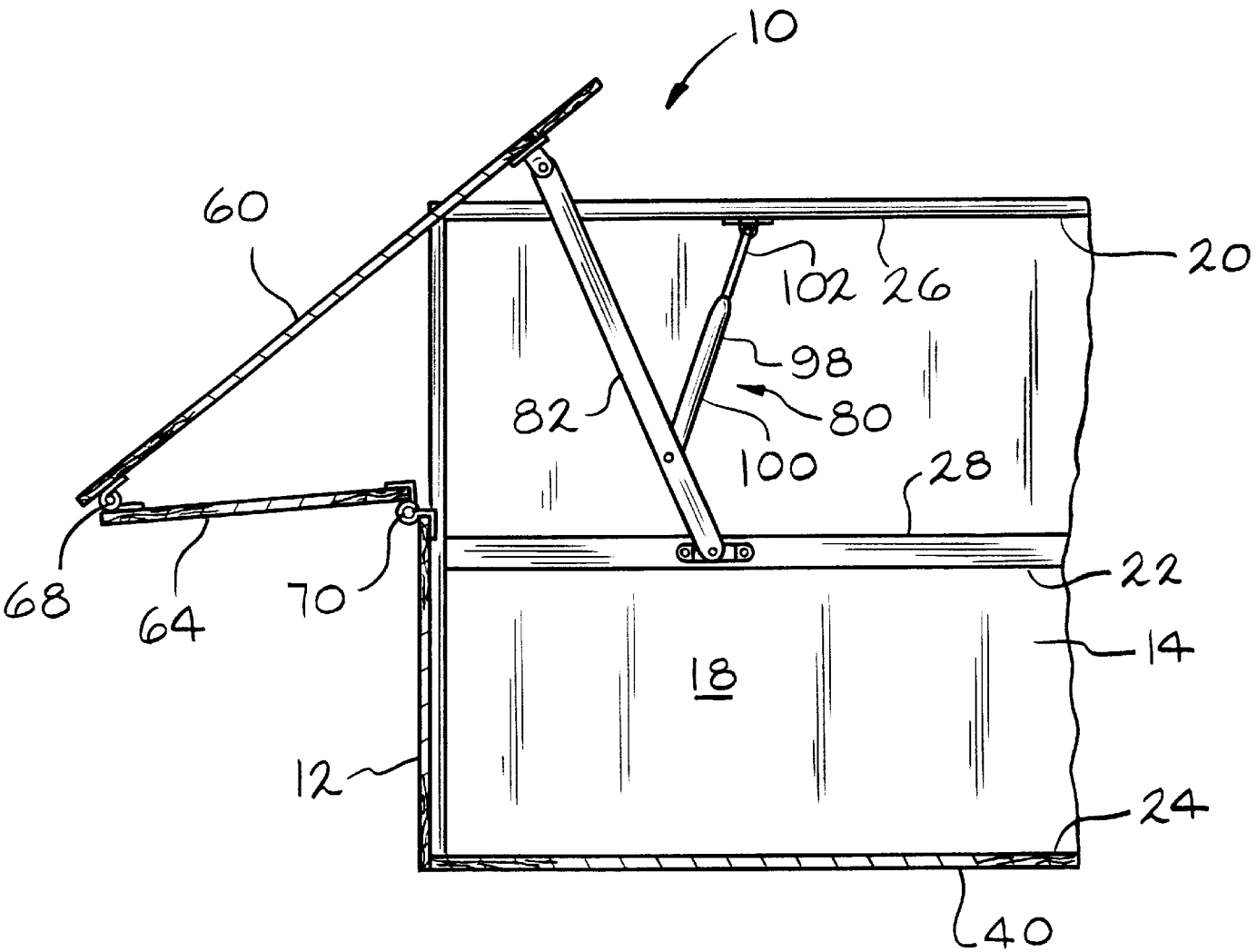
FIG. 5 is a view similar to the view of FIG. 3 in which the first and second door members are in a partially open position.
Figure 6:
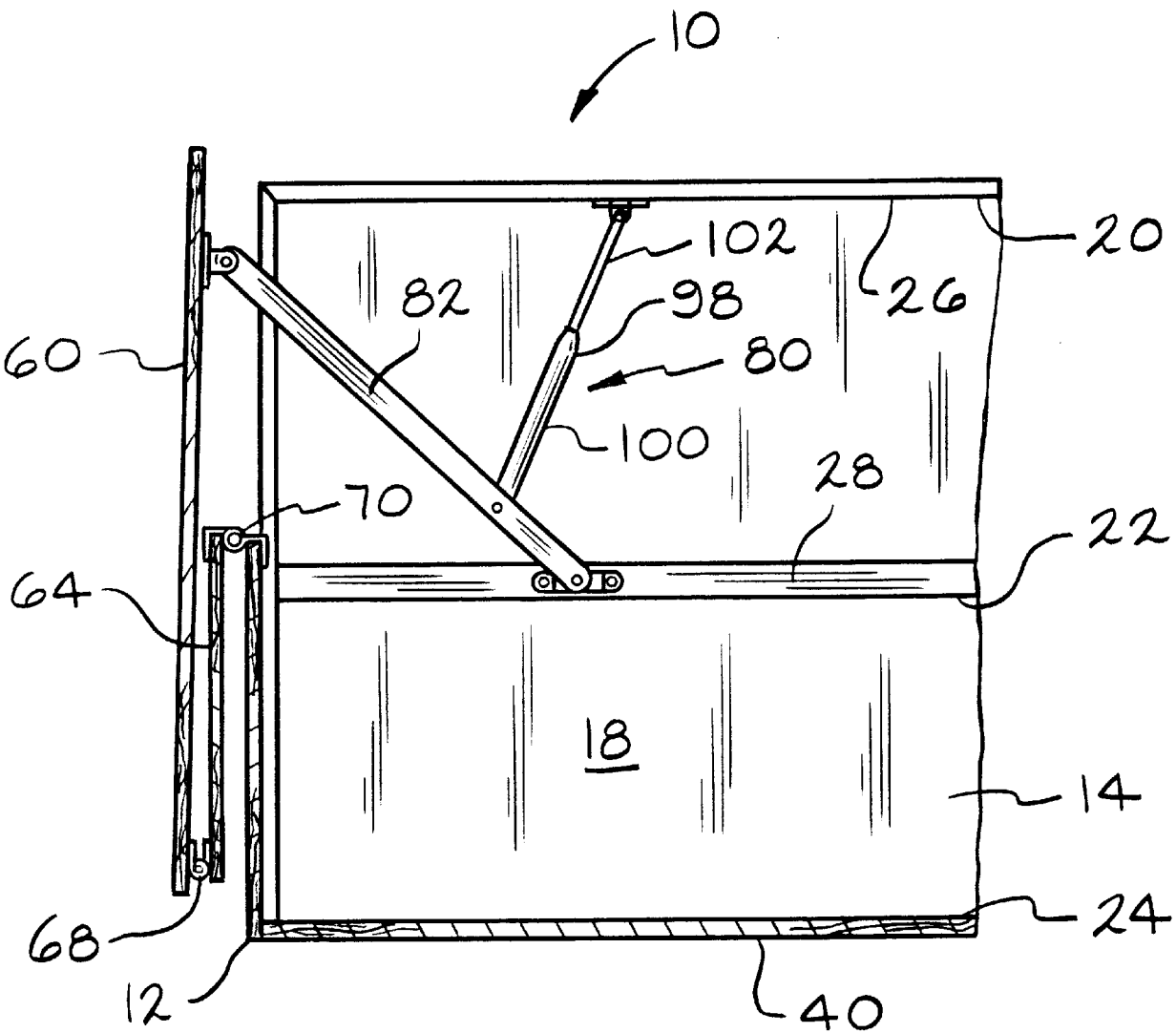
FIG. 6 is a view similar to the view of FIG. 3 in which the first and second door members are in an open position.

Referring to FIGS. 3–6, the first and second door members 60, 62, 64 and 66, respectively, as represented by first and second door members 60 and 64, can be moved from a fully closed position as shown in FIG. 3 to a fully open position as shown in FIG. 6 and to a variety of positions therebetween as shown in FIGS. 4 and 5. Referring to FIGS. 4 and 5, the arm 82 and the stay 98 of the hinge assembly 80 cooperate to guide and control movement of the first and second door members 60 and 64 during opening and closing. The arm 82 restricts the axial movement of the first and second door members 60 and 64 to the predetermined path defined by the arm. The reciprocating piston 102 of the stay 98 provides a predetermined resistance to the axial movement of the arm 82 during opening and closing of the first and second door members 60 and 64. As shown in FIG. 6, the first door members 60 and 62, as represented by the first door member 60, are adjacent the second door members 64 and 66, as represented by second door member 64, and the second door members 64 and 66, as represented by second door member 64, are adjacent the first and second side walls 32 and 34, as represented by first side wall 32, when the first and second door members 60 and 64 are in an open position. The arm 82 and the stay 98 of the hinge assembly 80 cooperate to maintain the first and second door members 60 and 64 in this arrangement.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A cabinet and door assembly comprising:

a cabinet having a horizontal member including a lower surface and at least one side wall;

at least one first door member and at least one second door member, said first door member being pivotly mounted on said second door member, said second door member being pivotly mounted on said side wall, said first and second door members being moveable between closed and open positions; and hinge means operatively connected to said lower surface and said first door member for guiding said first and second door members during movement between said closed and open positions.

2. The cabinet and door assembly of claim 1, wherein said cabinet includes a base, said assembly including two first door members extending between said top and said base, two second door members extending between said top and said base, and two spaced side walls extending between said top and said base, whereby said top, base, first door members, second door members and side walls define a compartment when said first and second door members are in said closed position.

3. The cabinet and door assembly of claim 2, wherein said cabinet includes a support shelf extending substantially between said side walls.

4. The cabinet and door assembly of claim 2, wherein said cabinet includes a top shelf extending substantially between said side walls.

5. The cabinet and door assembly of claim 1, wherein said first door member is pivotly mounted on said second door member by at least one hinge.

6. The cabinet and door assembly of claim 1, wherein said second door member is pivotly mounted on said side wall by at least one hinge.

7. The cabinet and door assembly of claim 1, wherein said lower surface includes a front portion and a middle portion, said hinge means being comprised of an arm extending between said middle portion and said first door member, and a stay extending between said arm and said front portion.

8. The cabinet and door assembly of claim 7, wherein said arm includes a first end and a second end, said first end being movably mounted on said middle portion, said second end being movably mounted on said first door member.

9. The cabinet and door assembly of claim 8, wherein said stay includes a housing and a reciprocating piston positioned in said housing, said housing being movably mounted on said arm, said piston being movably mounted on said front portion.

10. The cabinet and door assembly of claim 1, wherein said first door member being adjacent said second door member, and said second door member being adjacent said side wall when said first and second door members are in said open position.

11. The cabinet and door assembly of claim 1, wherein said horizontal member is a top.

* * * * *